US005442835A

United States Patent [19]

Walker et al.

[11] Patent Number: 5,442,835

[45] Date of Patent: Aug. 22, 1995

[54] SCREENS FOR A CARDING MACHINE

[75] Inventors: Fletcher Walker; Thomas A. Dixon, both of Gastonia, N.C.

[73] Assignee: Jenkins Metal Corporation, Gastonia, N.C.

[21] Appl. No.: 267,010

[22] Filed: Jun. 15, 1994

[51] Int. Cl.[6] ..... D01G 15/34

[52] U.S. Cl. ..... 19/95; 19/107

[58] Field of Search ..... 19/59, 64, 107, 109, 19/95, 105, 110, 114; 241/74, 79.1, 79.3, 79.2; 209/675, 393, 395

[56] References Cited

U.S. PATENT DOCUMENTS

| | | | |
|---|---|---|---|
| 488,684 | 12/1892 | Whittle | 19/95 |
| 620,089 | 2/1899 | Threlfall | 19/105 |
| 656,871 | 8/1900 | White | 19/95 |
| 1,559,475 | 10/1925 | Thomas | 19/105 |
| 2,289,017 | 7/1942 | Jenkins et al. | 19/107 |
| 3,348,268 | 10/1967 | Jenkins, Sr. | 19/95 |
| 3,849,837 | 11/1974 | Bass, Jr. et al. | 19/107 |
| 4,135,275 | 1/1979 | Gunter et al. | 19/107 |
| 4,502,185 | 3/1985 | Jenkins, Jr. | 19/95 |

FOREIGN PATENT DOCUMENTS

| | | | |
|---|---|---|---|
| 0155720 | 8/1985 | Japan | 19/107 |

OTHER PUBLICATIONS

Jenkins Metal Corp., "the Even Flow Screen", Jan. 1, 1995.

*Primary Examiner*—Clifford D. Crowder
*Assistant Examiner*—Ismael Izaguirre
*Attorney, Agent, or Firm*—Clifton Ted Hunt

[57] ABSTRACT

A card screen and a lickerin screen are provided for a forty inch carding machine having the usual side ribs and end blanks. The grid bars in both the card screen and the lickerin screen are of triangular configuration in cross-section and are structured to provide increased air flow for the removal of trash. One side of each grid bar extends downwardly in use at an angle of about 50° to the radii of the main cylinder, or lickerin roll, another side extends radially from the main cylinder, and the third side extends between the first two sides in closely spaced substantially parallel relation to the main screen. There is no center rib and the grid bars extend the entire distance between the side ribs.

7 Claims, 3 Drawing Sheets

SCREENS FOR A CARDING MACHINE

FIELD OF THE INVENTION

This invention relates to an improved card screen and to an improved lickerin screen of the type used on carding machines in the textile industry.

BACKGROUND OF THE INVENTION

Most of the card screens and lickerin screens in current use are between forty (101.6 cm) and forty five inches (114.3 cm) wide, but the width of the carding machine screens with which this invention is described varies between forty (101.6 cm) and and sixty inches (152.4 cm). For convenient reference, the term "forty inch screen" (101.6 cm screen) is used herein to refer to screens having a width between forty (101.6 cm) and sixty inches (152.4 cm).

THE PRIOR ART FORTY INCH (101.6 cm) SCREEN

The prior art forty inch (101.6 cm) card screen extends between the sides of the carding machine and between the lickerin and the doffer. The width of a card screen, and of the lickerin screen, is about the same as, but slightly less than, the width of the carding machine with which the two screens are used. The length of the card screen, meaning the combined length of the front and rear portions of the card screen, ranges from fifty (127 cm) to sixty four inches (162.56 cm).

The front and rear portions of a card screen are formed in an arc when viewed from the side and the two portions are joined together beneath the axis of the main cylinder to form an arc conforming with the curvature of the main cylinder. The front and back screens each comprise side ribs extending along opposite sides of the screen and a center rib extending in equally spaced parallel relation to the side ribs. Transverse blanks extend between the side ribs adjacent the lickerin and the doffer, and sturdy end bars are conventionally provided at the juncture of the front and rear screen portions at the center of the screen. The function of the sturdy end bars is to brace and strengthen the center of the screen.

Bars the size of end bars are used as grid bars in large card screens measuring from sixty (152.4 cm) to one hundred inches (254 cm) in width. The length of these large bars is only half the width of the large screens and the large bars extend from the sides of the screen to a center rib because of the strength needed on these large card screens.

A plurality of less sturdy grid bars, each having a circumferential dimension less than that of the end bars, extend transversely of the conventional forty inch (101.6 cm) card screen and lickerin screen. The length of the grid bars is equal to half the width of the card screen and the grid bars extend between the side ribs and the center rib. The grid bars are spaced from each other about 3/16 of an inch (0.47625 cm), and their ends are soldered to the side ribs and to the center rib. There may be as many as eighty two grid bars in a conventional card screen, but the number of grid bars varies from screen to screen.

All card screens are spaced a predetermined distance, measured in thousandths of an inch (2540 cm), from the lower periphery of the main cylinder. The main cylinder rotates at speeds of thirty five to fifty miles per hour, throwing trash and non-spinnable fibers from the lap and against the card screen. It is intended that the trash and non-spinnable fibers pass through the 3/16ths" (0.47625 cm) air spaces between adjacent grid bars to be removed as waste.

In fact, the center rib in the prior art card screens retains an undesirable quantity Of the trash and non-spinnable fibers at its junctures with the grid bars. Much of the retained trash and non-spinnable fibers builds up on the inner surface of the card screen at the junctures of the center rib with the grid bars. These accumulations of trash and non-spinnable fibers sometimes extends into engagement with the lap being processed on the rapidly rotating main cylinder, resulting in slubs (non-spinnable fibers) and consequent reduction in the quality of the sliver produced by the carding machine.

SUMMARY OF THE INVENTION

There is no center rib in the card screen or lickerin screen of the present invention. The grid bars extend the entire distance between the side ribs, and are of triangular configuration in cross-section and are structured to provide increased air flow for the removal of trash. One side of each grid bar extends downwardly in use at an angle of about 50° to the radii of the main cylinder, or lickerin roll, another side extends radially from the main cylinder, and the third side extends between the first two sides in closely spaced substantially parallel relation to the main cylinder.

An improved lickerin screen is formed in the same manner.

Elimination of the center rib removes the major obstacle to the passage of trash and non-spinnable fibers through the card screen and lickerin screen, thereby resulting in more waste passing between the grid bars of the improved screens and less waste remaining on the screens to interfere with the carding operation. The quality of the sliver is improved accordingly.

DETAILED DESCRIPTION OF THE INVENTION

Referring more specifically to the drawings, the numeral 10 broadly designates the improved card screen, comprising a rear screen section 11 and a front screen section 12 joined together at the center of the card screen 10, as at 13.

Figure 1:
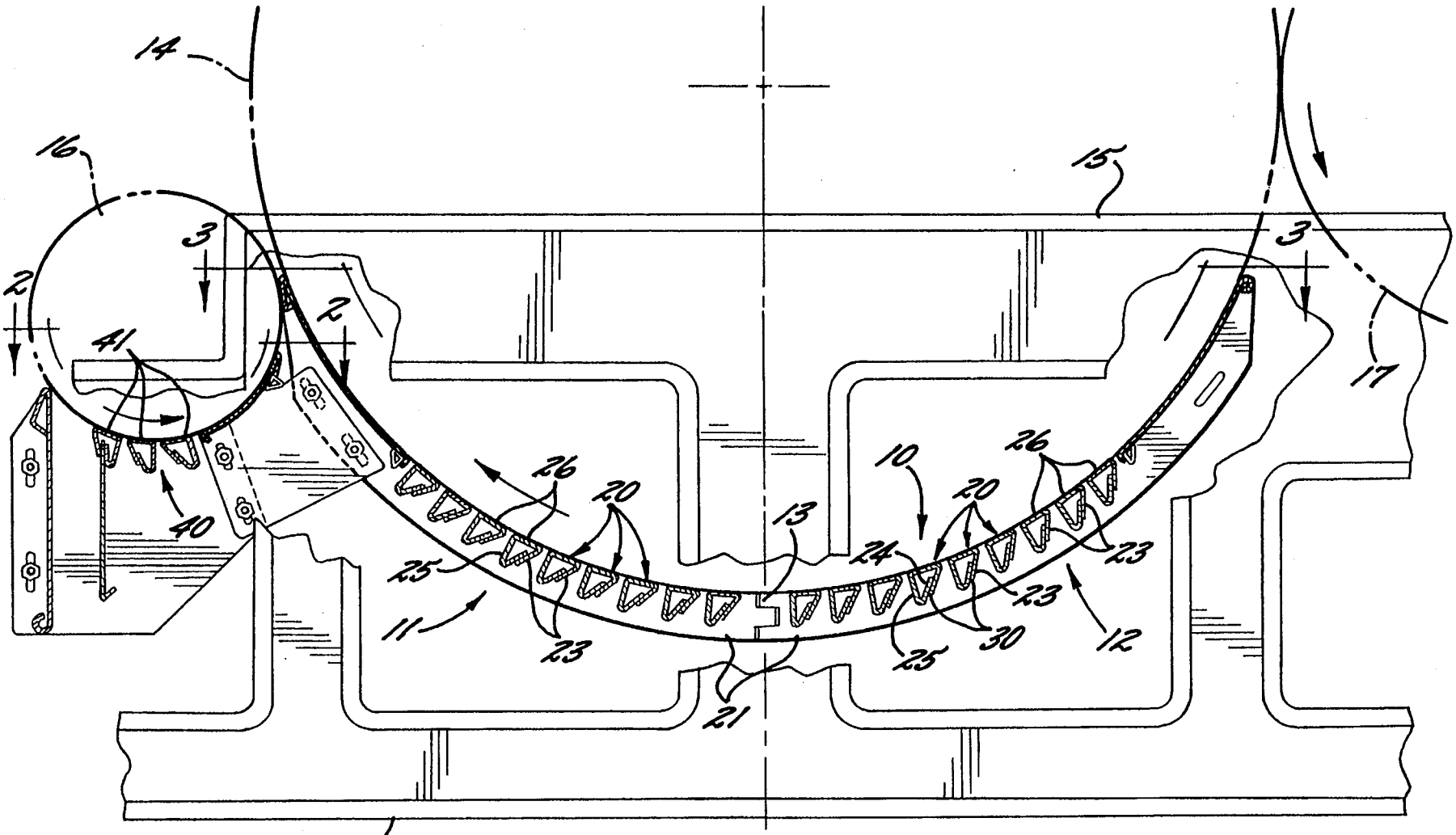
FIG. 1 is a longitudinal sectional view, with parts broken away, through the lickerin, main cylinder, and part of the doffer of a carding machine, illustrating the improved screens of the present invention.
Figure 2:
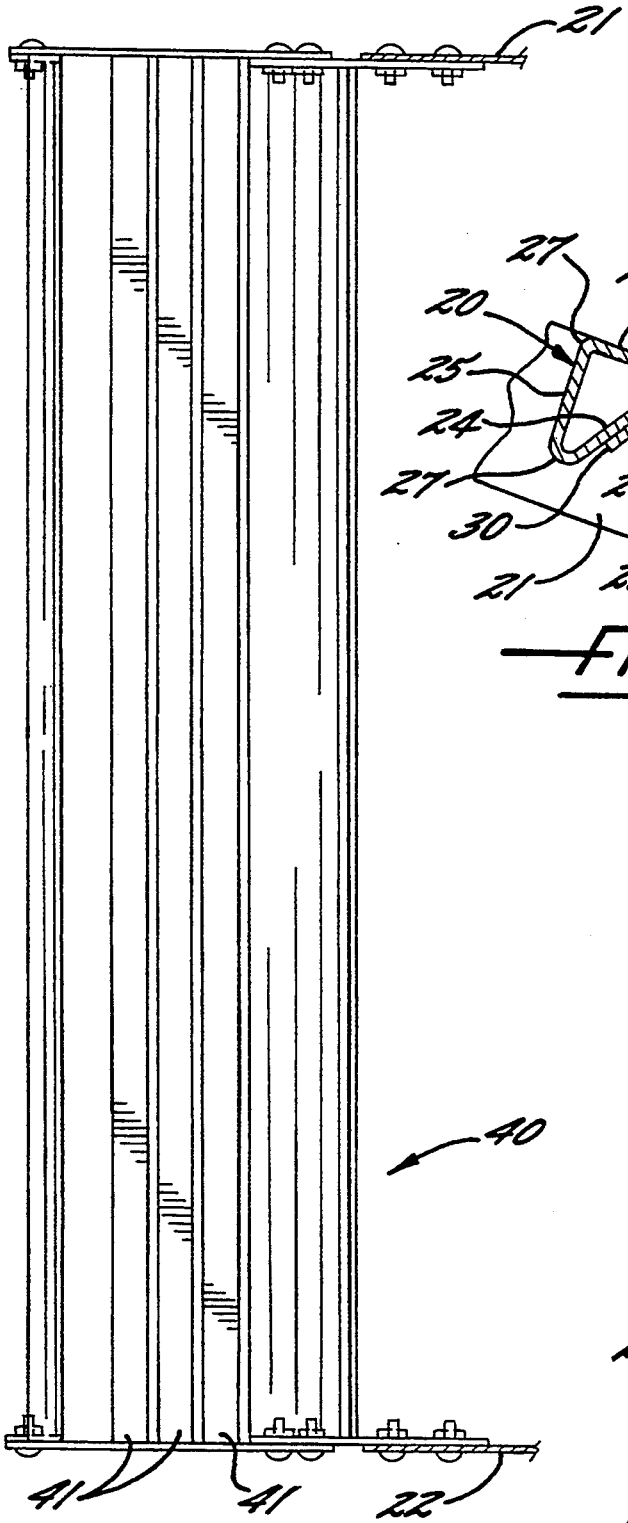
FIG. 2 is a plan view of the improved lickerin screen, taken substantially along the line 2—2 in FIG. 1.
Figure 4:
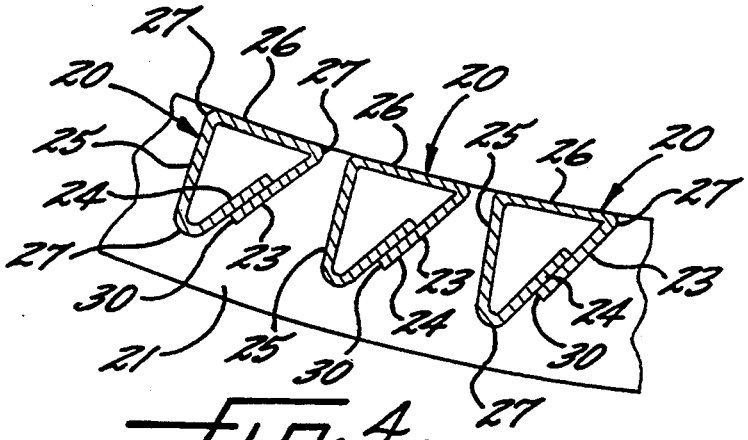
FIG. 4 is a sectional view of adjoining even-flow bars in the card screen, taken substantially along the line 4—4 in FIG. 3.
Figure 5:
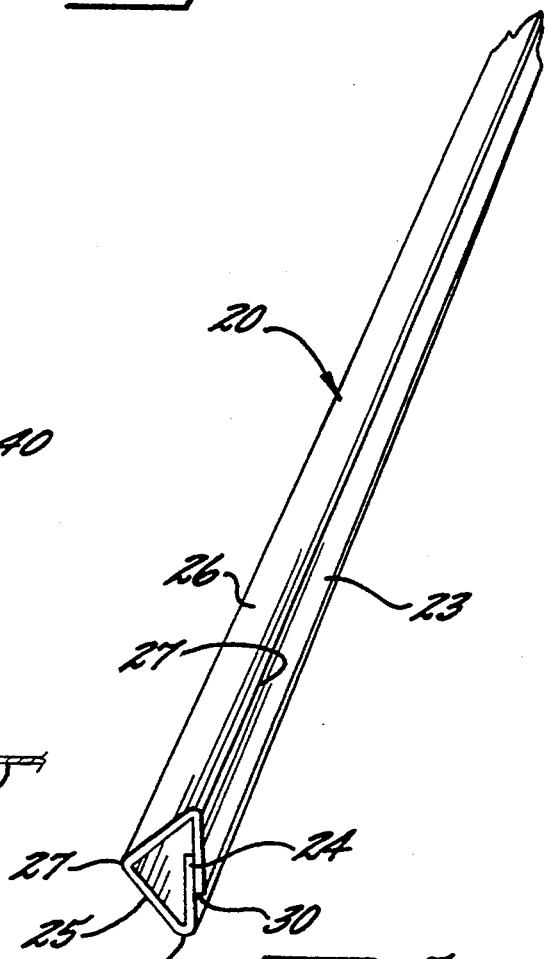
FIG. 5 is a perspective view, with parts broken away, of one of the even-flow bars shown in FIG. 4, removed from the card screen.

The card screen 10 is beneath and in closely spaced relation (several thousandths of an inch (2540th of a cm)) to the main cylinder 14 of a forty inch (101.6 cm) carding machine, schematically illustrated in FIG. 1 and having a frame 15, a lickerin roll 16, and a doffer cylinder 17.

The Improved Card Screen

Figure 3:
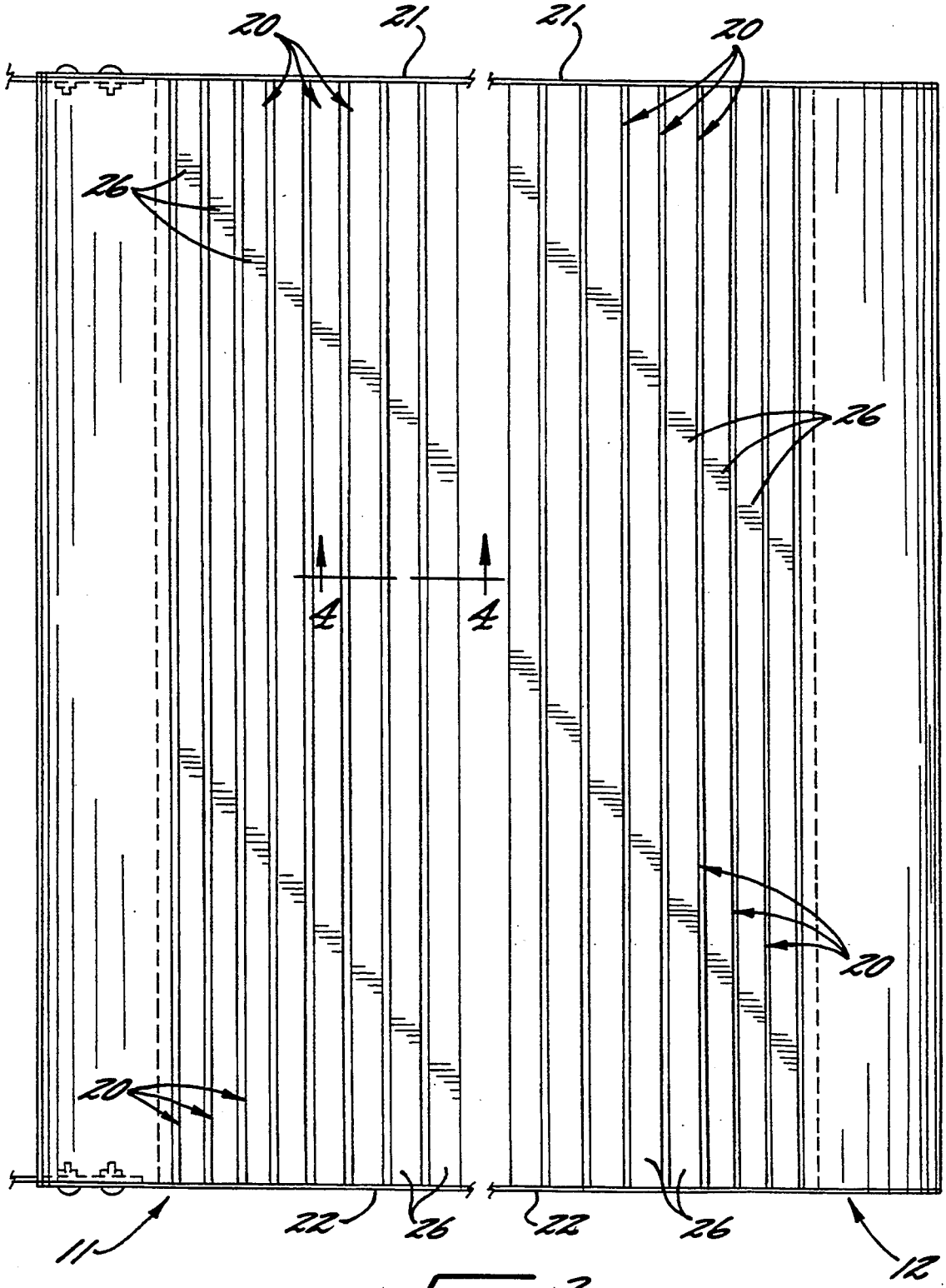
FIG. 3 is a plan view of the improved card screen, taken substantially along the line 3—3 in FIG. 1.

The improved card screen 10 comprises a plurality of sturdy grid bars 20. The grid bars 20 are approximately forty inches (101.6 cm) long and extend the full distance between opposed side ribs 21 and 22. The center rib that is conventionally used in forty inch (101.6 cm) card screens is omitted in the screens of the present invention (FIG. 3).

One side 23 of each grid bar 20 is seamed as at 24. The seamed side 23 of each grid bar preferably has a width between one inch (1") (2.54 cm) and one and three eighths inches (1 and $\frac{3}{8}$") (3.4925 cm), and an adjoining side 25 of each grid bar 20 preferably has a width of approximately seven eighths of an inch ($\frac{7}{8}$") (2.2225 cm). The remaining side 26 of each of the triangularly shaped grid bars 20 is about five eighths of an inch ($\frac{5}{8}$") (1.5875 cm) wide. The corners between each of the three sides of the triangularly-shaped grid bars are rounded as at 27.

As seen in FIG. 1, the grid bars 20 are fixed to the side ribs 21 and 22 with the sides 25 of the grid bars 20 extending radially from the main cylinder in use. The wider seamed sides 23 face the air currents generated by the rapidly rotating main cylinder and extend downwardly in use at an angle of about 50° to the radii of the main cylinder, with the outer ends 30 of the seams 24 facing downwardly to avoid snagging of the trash and non-spinnable fibers that impinge upon the screen. The configuration and positioning of the grid bars has a beneficial effect on the air flow that carries trash and non-spinnable fibers away from the main cylinder and through the air spaces between the grid bars. Specifically, the approximately 50° angle at which the seamed side 23 extends from the radius of the main cylinder and the relatively greater width of the side 23, coupled with the alinement of the sides 25 with the radii of the main cylinder increases the flow of air through the screen. Consequently, the retention of residue on the screen is reduced.

The grid bars 20 are soldered or otherwise fixed to the side ribs 21, 22 in perpendicular relation to the side ribs and in spaced parallel relation to each other. The grid bars 20 are preferably spaced one quarter of an inch ($\frac{1}{4}$") (0.635 cm) apart to define spaces 31 between the grid bars 20.

In use, the trash and non-spinnable fibers carried by the air currents impinge upon the downwardly angled seamed sides 23 of the grid bars 20, and are directed into the spaces 31 between the bars 20.

The novel angularity and width of the grid bars, the increased space between bars, and the absence of a center rib contribute to the effective elimination of trash and non-spinnable fibers from the lap being processed with a consequent improvement in the quality of the sliver.

The Lickerin Screen

A novel lickerin screen 40 is conventionally spaced beneath the lickerin roll 16. The screeen 40 includes grid bars 41, which are the same size and structure as the grid bars 20 in the card screen 10. The grid bars 41 provide the same improvement in the elimination of trash and non-spinnable fibers as do the grid bars 20 in the improved card screen 10.

It is the foregoing believed description of the lickerin screen 40 is sufficient for an understanding of this embodiment of the invention and that a further description is unnecessary.

Summary

There is thus provided an improvement in the structure of the screens used on carding machines which eliminates the central rib and increases the usable air space for trash and non-spinnable fibers.

The elimination of the central rib is economically advantageous because of the consequent reduction in material and labor costs.

The elimination of the central rib and the increased air space between the grid bars is functionally advantageous because of the improved removal of waste from the screens and the consequent improvement in the quality of the sliver.

We claim:

1. A screen for use with a carding machine having a rotatable cylinder, the screen having side ribs and grid bars, each grid bar being of triangular configuration in cross-section and extending the entire distance, without interruption, between the side ribs, each grid bar being fixed to the side ribs with one side extending downwardly at about a 50° angle to a radius of a rotatable cylinder and facing air currents generated during rotation of a cylinder in use, a second side of each grid bar extending radially from a radius of a cylinder in use, the third side of each grid bar extending in substantially parallel relation to the circumference of a cylinder in use, said one side of each grid bar being of a greater width than the other two sides, and the second side of each grid bar being of a greater width than the third side of that grid bar.

2. The invention of claim 1 wherein the screen is a card screen.

3. The invention of claim 1 wherein the screen is a lickerin screen.

4. The invention of claim 1 wherein the width of said one side of the grid bars is in the range of $\frac{1}{8}$th to $\frac{1}{2}$ inch more than the width of the second side of the grid bars.

5. The invention of claim 4 wherein the width of said third side of the grid bars is $\frac{5}{8}$ of an inch.

6. The invention of claim 1 wherein said one side of the grid bar is seamed.

7. The invention of claim 6 wherein one portion of the seam overlaps another portion and wherein the overlapping portion extends downwardly in use.

* * * * *